United States Patent [19]

Zucchini

[11] 3,977,218

[45] Aug. 31, 1976

[54] WASHING AND DRYING PLANT-DEVOID OF ANY ISOLATING VALVE

[75] Inventor: Guido Zucchini, Bologna, Italy

[73] Assignee: AMA Universal S.p.A., Bologna, Italy

[22] Filed: May 13, 1976

[21] Appl. No.: 576,953

[30] Foreign Application Priority Data

Dec. 6, 1974 Italy ..... 3549/74

[52] U.S. Cl. ..... 68/18 R; 210/167; 210/314; 68/18 C; 68/18 F

[51] Int. Cl.[2] ..... D06F 43/08

[58] Field of Search ..... 68/18 R, 18 C, 18 F, 68/20; 34/77, 82; 210/167, 314

[56] References Cited

UNITED STATES PATENTS

| | | | |
|---|---|---|---|
| 1,291,266 | 1/1919 | Traube | 68/18 R X |
| 1,775,699 | 9/1930 | Silver | 68/18 R X |
| 2,966,922 | 1/1961 | Wallis | 68/18 R X |
| 3,002,287 | 10/1961 | Smith | 68/18 C X |
| 3,206,950 | 9/1965 | Xeros | 68/18 R X |
| 3,232,081 | 2/1966 | Severance et al. | 68/18 R |
| 3,246,493 | 4/1966 | Oles | 68/18 R |

*Primary Examiner*—Philip R. Coe
*Attorney, Agent, or Firm*—Browdy and Neimark

[57] ABSTRACT

Disclosed herein is a washing and drying plant for dry cleaning machines.

The plant in question is formed by two concatenated circuits, one of which for the washing and the other for the drying of the treated garments and both terminate at a washing tank positioned at a level higher than that of the rest of the plant.

Once the cycle has ended and the access door to the washing tank has been opened, it is possible in this way to prevent, without the intermediary of any isolating valve, the solvent gases built up during the operating cycles which, on account of their weight, remain inside the plant, from issuing therefrom.

4 Claims, 1 Drawing Figure

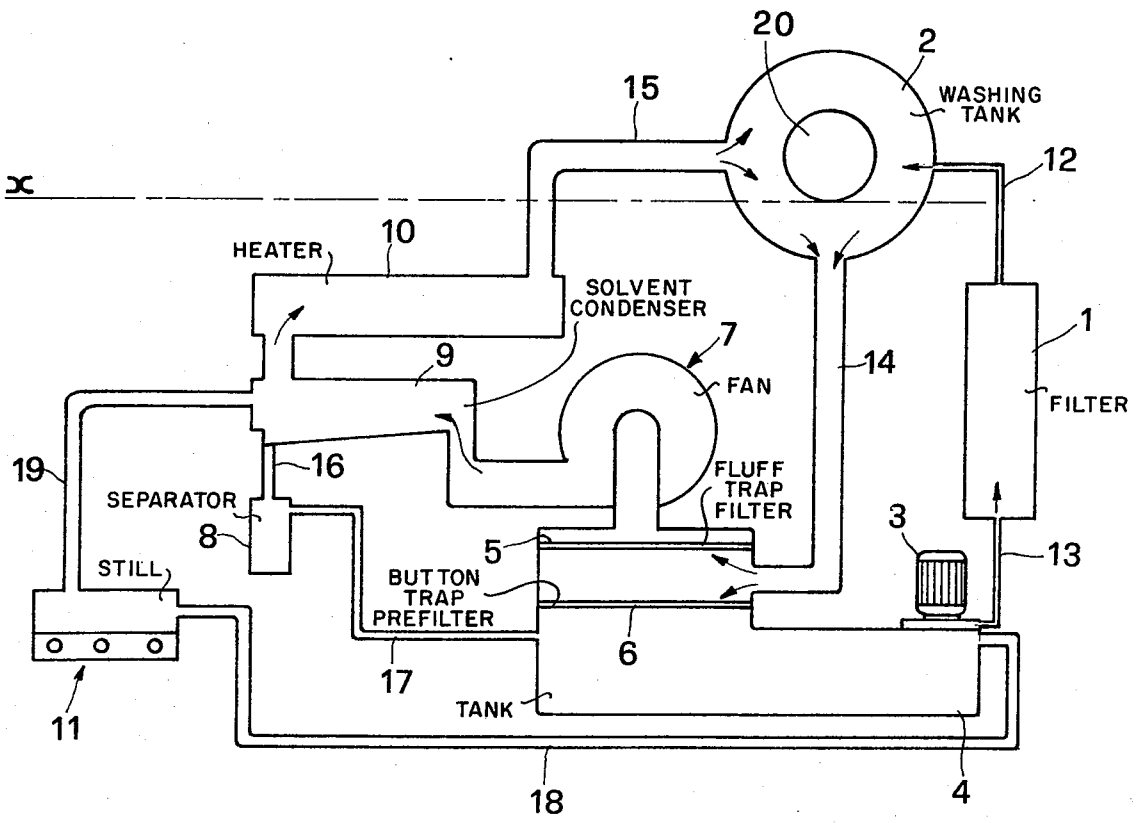
WASHING TANK
FILTER
FAN
FLUFF TRAP FILTER
SOLVENT CONDENSER
BUTTON TRAP PREFILTER
TANK
HEATER
SEPARATOR
STILL
1
2
3
4
5
6
7
8
9
10
11
12
13
14
15
16
17
18
19
20
X

WASHING AND DRYING PLANT-DEVOID OF ANY ISOLATING VALVE

BACKGROUND OF THE INVENTION

This invention relates to a washing and drying plant devoid of any isolating valve, particularly for dry cleaning machines suitable for the use of washing solvents with which the boiling points are relatively low.

DESCRIPTION OF THE PRIOR ART

The exigency the device in question is able to satisfy stems principally from the fact that in washing machines of a known type, the washing tank is normally placed at a level lower than that of the entire plant needed for the operation of the said machines.

As a consequence of this, when the access door to the washing tank is opened in order to allow the washed garments to be removed therefrom, the gases that build up in the inside of the said tank and in the pipework connecting it with the rest of the plant while the said machines are in operation, because of the lower level of the said tank with respect to the rest of the plant, overflow out of the said tank and the said pipework into the external atmosphere, thereby giving rise to a certain loss of solvent.

The loss of solvent used in the washing cycles is felt particularly in dry cleaning machines where low boiling point solvents are used such as, for example, "Valclene" for which it is especially difficult to achieve a satisfactory depuration and to recover the gases that have accumulated during the operating cycles in the inside of the said machines.

It was subsequently thought of providing the pipework linking the washing tank with the rest of the plant with an automatically interlinked valve system whereby at the time the access door to the washing tank was opened, the said pipework would be sealed off and thus, in this way, only the gases contained in the tank, the quantity of which is small, would be allowed to overspill. This obviously represented a considerable financial benefit since the cost of the solvents habitually used in the aforementioned washing plants is high.

SUMMARY OF THE INVENTION

The object of the present invention is to overcome the aforementioned difficulties and, in particular, to make available a plant for dry cleaning and drying in which it is possible to limit to the small quantities contained in the washing tank, the solvent gas losses, yet, at the same time, to dispense with any device for isolating the said gases along the pipework connecting the said tank with the rest of the plant, the advantage of this being to consequentially be able to realize a plant that is constructionally extremely simple and is highly economical to run.

This and other objects too are attained with the device according to the present invention, an essential feature of which is that it has all its component parts positioned at a level lower than that of the said washing tank.

BRIEF DESCRIPTION OF THE DRAWING

Further characteristics and advantages of the invention will emerge more clearly from the following detailed description of a preferred but not the sole form of embodiment for the plant in question, illustrated purely as an unlimited example on the accompanying drawing in which the sole FIGURE shows in diagrammatic form one way in which the plant in question can be realized, consisting essentially of two concatenated circuits: one for the actual washing operation and the other for drying the treated garments.

DESCRIPTION OF THE PREFERRED EMBODIMENT

From an examination of the first circuit shown in the FIGURE it can be seen that a washing tank 2 communicates with a filter 1 of a known type via a pipe 12.

At 3 there is a suction pump connected to a solvent tank 4, the delivery to the said filter 1 being through a pipe 13.

In turn, the tank 4 communicates directly with the said washing tank by means of a pipe 14 which is completely free from any isolating device.

During the washing phase, there is a constant circulation of solvent in this circuit and, to be more exact, the pump 3 draws the solvent from the tank 4 and through the pipe 13, pushes it into the filter 1 thence, through the second pipe 12, into the washing tank 2 where the garments to be washed are treated.

From the said tank 2, the solvent passes along the pipe 14 and arrives back in the said tank 4 after, however, having gone through a button trap prefilter 6 which, in the specific case under consideration, is located in the inside of the aforementioned tank 4.

In this connection it should be noted that the said tank 4 is of a shape such that in addition to containing the above mentioned button trap prefilter 6, it is also able to house a fluff trap filter 5 needed, as will be seen, following the filtering of the air at the drying time.

Once the washing phase has been completed, the subsequent drying phase takes over and for this the aforementioned second circuit is utilized.

As can be seen from the FIGURE, the solvent tank 4 communicating with the washing tank 2 via the pipe 14 is connected to the suction of a fan 7. The throw of the said fan 7 communicates with a solvent condenser 9 of a known type, whose outlet is connected to a heater 10 of a known type that communicates through a pipe 15 with the said washing tank 2. Finally at 8 there is a separator of a known type and this communicates at one end with the condenser 9 via a pipe 16 and with the tank 4 via a second pipe 17.

During this second drying phase, after the mixture of air and solvent drawn in by the fan 7 has passed through the pipe 14, it goes into the tank 4 where an initial separation of the part of the solvent that has turned into condensate during its travel, takes place. Subsequently the mixture of air and solvent passes through the fluff trap filter 5 and the fan 7 and goes into the condenser 9 in which the recovery of the solvent is effected.

The condensate amasses in the separator 8, the purpose of which is to resolve from the solvent any impurities which inevitably form during condensation and principally those derived from the water vapour contained in the air and in the garments at the time they are put into the washing tank.

The air that comes out of the condenser 9 is then heated in the heater 10 and is returned to the washing tank 2, thereby causing a fresh drying cycle to be commenced.

Again in the said FIGURE, a still 11 is connected to the delivery of the pump 3 via a pipe 18 and to the said condenser 9 via a pipe 19.

The said still is put into operation when the plant is not running: by switching the delivery of the pump 3 over to the pipe 18, the solvent to be purified is made to reach the said still 11.

Here the solvent is caused to evaporate and, through the condenser 9 and the separator 8, it is subsequently returned, duly purified, to the tank 4.

Once again it is pointed out that the said pipes 12, 14 and 15 are devoid of any isolating device and that the washing tank is positioned at a level higher than that of the rest of the plant in such a way that the gases above the level line x tangential with the lower edge of the access door 20 of the tank 2 will discharge outwards because of their weight, while those below the said line x will remain in the inside of the plant.

In its practical form of embodiment, the invention can differ from what has been described above and, in particular, numerous modifications of a practical nature can be made to the constructional details without this in any way affecting the protection afforded to the present invention.

What is claimed is:

1. An apparatus for cleaning and drying which is free of cut-off valves, the apparatus comprising, in combination:

a constant circulation solvent cleaning circuit free of cut-off valves and having a solvent tank for holding solvent, a pump for drawing and circulating solvent from said tank, a solvent filter for filtering solvent drawn by said pump, a wash tank having an inlet connected to said solvent filter and an outlet connected to said solvent tank, said wash tank being positioned at a level higher than both said solvent tank and said filter for solvent drawn by said pump, and a second filter for filtering solvent exiting from said wash tank; and a garment drying and solvent recovering circuit free of cut-off valves and having a fan with an intake and an outlet, said intake being connected to said solvent tank above expected maximum level of solvent and being positioned at a higher level than said solvent tank, a condenser positioned at a higher level than said solvent tank, said outlet of said fan being connected to said condenser, a separator having an inlet connected to said condenser and an outlet connected to said solvent tank, an air heater having an intake which is connected to said condenser and an outlet, said wash tank having an additional inlet connected to said outlet of said air heater, said wash tank also being positioned at a higher level than said fan, said condenser, said separator and said air heater, and a fluff trap filter positioned adjacent said intake of said fan for filtering the fluid arriving at said fan, said fluff trap being positioned at a level lower than said wash tank.

2. An apparatus for cleaning and drying according to claim 1, further including a still for purifying solvent, said still having an inlet connected to said solvent tank and an outlet connected to said condenser, said still being positioned at a lower level than said wash tank.

3. An apparatus for cleaning and drying according to claim 2, wherein said second filter for filtering solvent exiting from said wash tank and said fluff trap filter are located inside said solvent tank, said second filter and said fluff trap filter being positioned at levels higher than the maximum level solvent reaches in said solvent tank.

4. An apparatus for cleaning and drying according to claim 1, wherein said second filter for filtering solvent exiting from said wash tank and said fluff trap filter are located inside said solvent tank, said second filter and said fluff trap filter being positioned at levels higher than the maximum level solvent reaches in said solvent tank.

* * * * *